US006450848B1

(12) United States Patent
Skedeleski

(10) Patent No.: US 6,450,848 B1
(45) Date of Patent: Sep. 17, 2002

(54) SURFBOARD TAIL PROTECTOR

(75) Inventor: David Skedeleski, Pearl City, HI (US)

(73) Assignee: Surfoo Hawaii, Pearl City, HI (US)

( * ) Notice: Subject to any disclaimer, the term of this patent is extended or adjusted under 35 U.S.C. 154(b) by 0 days.

(21) Appl. No.: 09/835,420

(22) Filed: Apr. 17, 2001

Related U.S. Application Data

(60) Provisional application No. 60/240,797, filed on Oct. 17, 2000.

(51) Int. Cl.[7] ..... B63B 35/79
(52) U.S. Cl. ..... 441/74; 114/219
(58) Field of Search ..... 114/219; 441/65, 441/74

(56) References Cited

U.S. PATENT DOCUMENTS 4,209,867 A * 7/1980 Abrams, III ..... 441/74
4,586,451 A * 5/1986 Mori ..... 114/219
4,719,952 A * 1/1988 Geronimo ..... 441/74
4,792,316 A 12/1988 Skedeleski et al.
4,955,314 A 9/1990 Skedeleski et al.
5,174,220 A 12/1992 Skedelseski et al.
5,273,472 A 12/1993 Skedeleski et al.
5,484,312 A * 1/1996 Zepeda ..... 441/74
6,012,734 A 1/2000 Skedeleski

* cited by examiner

*Primary Examiner*—Stephen Avila
(74) *Attorney, Agent, or Firm*—Nixon & Vanderhye P.C.

(57) ABSTRACT

A tail protector is disclosed that provides a soft bumper attached to the rear edge of a surfboard, or other water sport board, or snowboard. The tail protector is to protect a surfer struck by the edge of the tail section of the surfboard and protects the tail section of the board from damage. The tail protector is a strip of deformable plastic material that wraps around the tail of the board and is adhesively attached to the board. The tail protector does not extend to the bottom of the board so as to not interfere with the performance of the board.

26 Claims, 5 Drawing Sheets

SURFBOARD TAIL PROTECTOR

RELATED APPLICATION

This application is related and claims priority to U.S. Provisional Patent Application Serial No. 60/240,797, entitled "Surfboard Tail Protector", filed Oct. 17, 2000.

BACKGROUND AND SUMMARY OF INVENTION

The invention relates to a protector that is used in association with a surfboard, or other water sport board, or snowboard. The primary purpose of the tail protector is to protect a surfer, or other sport enthusiast, from injury when struck by the edge of the tail section of the surfboard. The tail protector will also protect the tail section of the surfboard from damage when it is impacted against a hard surface.

The tail is one of the thinnest sections of the conventional surfboard and is frequently damaged during use and when transported. Conventional surfboards are constructed with polyurethane foam that is then shaped and glassed with fiberglass cloth impregnated with polyester resin. This construction provides a very hard, but brittle, surface that can crack and shatter when struck against hard objects. The hard, thin rear edge of the tail of a surfboard can injure swimmers who collide with the tail of the board. By functioning as a shock absorbing bumper, the tail protector according to the invention reduces damage to the board and to individuals.

While other sections of surfboards, or snowboards, have been provided with soft surfaces for user safety, or board protection, in the past (see, for example, U.S. Pat. Nos. 4,792,316, 4,955,314, 5,174,220, 5,273,472, and 6,012,734, the disclosures of all of which are hereby incorporated by reference herein), protecting water sport enthusiasts against impact from the tail section of the board has not heretofore been practiced.

The tail protector does not interfere with the performance of the surfboard in the water. The performance of the surfboard is determined in large part by the flow of water along the bottom surface of the board. The flow of water along the bottom surface of the board should be uninterrupted and free of turbulence. To promote laminar and turbulent free flow, the bottom surface should be smooth, free of protrusions and sharp corners. Such protrusions, corners and other interruptions on the bottom surface can disrupt the flow of water under that surface and create drag that slows the surfboard and otherwise impairs its performance. Accordingly, the tail protector should not create a protrusion on the bottom surface of the surfboard that would interrupt the flow of water under the board.

The tail protector must be thick enough to provide a bumper shield the tail of the surfboard without creating a sharp bump on the bottom of the board. A thick tail protector formed of a deformable material, such as silicon rubber, protects the tail of the surfboard. If the tail protector is too thin, then it will not provide sufficient protection for the tail of the surfboard.

A thick tail protector can create a bump on the underside of the surfboard if the protector extends to the bottom surface of the board. The tail protector does not extend to the bottom of the board. The tail protector wraps around the tail of the surfboard without extending to the bottom surface of the board. In particular, the tail protector has a bottom edge that is aligned with a curved section of the board that is between the edge (rail) and the bottom surface of the board.

Because the tail protector does not extend to the bottom surface of the board, it does not disrupt the flow of water underneath the board.

The tail protector is a thick strip of deformable material, such as silicon rubber that wraps around the tail of the surfboard. The cross section of the protector that generally has a comma shape, which is thin and short towards the bottom half of the protector and thick and extend at the top half of the protector. The protector also has rounded and V-shaped cutouts that allow the protector to fold around the side edges of the tail of the surfboard and conform to the rounded shape of the tail. The tail protector has an upper edge that extends above the tail and towards the upper surface of the board. The tail protector can extend onto the upper surface of the board without interfering with the performance of the board. The inside surface of the tail protector adheres to the surfboard by means of an adhesive, e.g., a glue. A glue may be applied to the inside surface of the tail protector to provide the adhesion necessary to hold the protector to the tail of the surfboard.

BRIEF DESCRIPTION OF THE DRAWINGS

These and other features and advantages provided by the invention will be better and more completely understood by referring to the following detailed description of presently preferred example embodiments in connection with the drawings, of which.

DETAILED DESCRIPTION OF AN EMBODIMENT OF THE INVENTION

Figure 1:
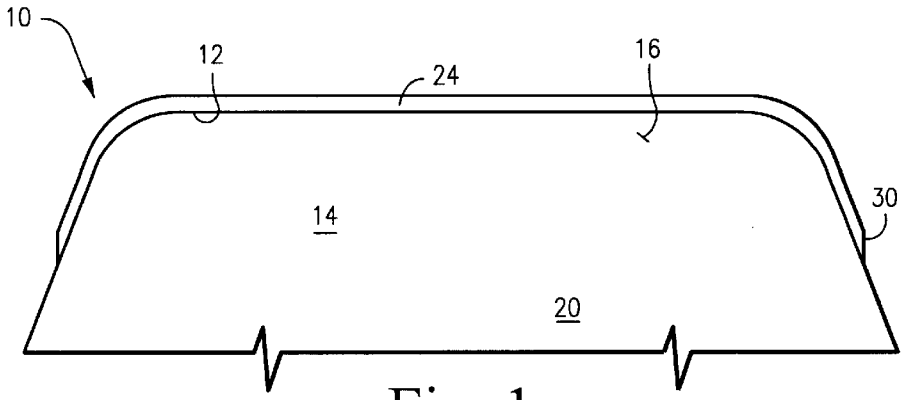
FIG. 1 is a bottom plan view of a tail portion of a surfboard with a tail protector embodying the present invention.
Figure 2:
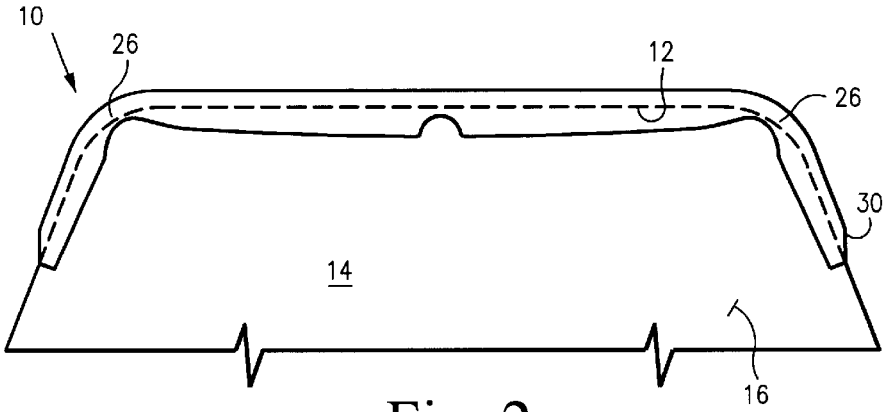
FIG. 2 is atop plan view of a tail portion of the surfboard and tail protector shown in FIG. 1.

Exemplary embodiments of a tail protector for a surfboard are shown in FIGS. 1 through 16 of the drawings. FIGS. 1 through 4 are, respectively, bottom, top, rear, and side views of an exemplary tail protector 10 according to the present invention shown mounted on the rear edge 12 a conventional surfboard 14. The tail protector engages the resin impregnated fiberglass skin (exterior) 16 of the inner foam core 18 of the body of the surfboard so that the protector is securely fastened to the rear edge of the surfboard. The tail protector may be permanently fastened to the rear edge of the surfboard at the time of manufacture of the surfboard or as an after-market add on product to a surfboard. Alternatively, the tail protector may be detachably attached to a surfboard so that the protector may be removed and replaced, as needed. The attachment between the tail protector and the surfboard may be a waterproof adhesive and/or a mechanical attachment mechanism, such as screws. Preferably the tail protectors are applied to the board using a very high bond peel and stick tape, such as disclosed in U.S. Pat. No. 6,012,734 (which is incorporated by reference herein).

As will seen in FIGS. 1 through 4, the tail protector 10 does not project to any significant extent whatsoever onto the bottom 20 of the surfboard. The bottom 20 of the surfboard is that portion of the board that is the underside surface of the board and under which the sea water flows in a substantially laminar flow. At the rear of the board, is a underside corner surface section 22 between the bottom of the board and the rear edge 12. The underside corner section 22 of the board tends to extend out of the water. If water does flow under the underside corner section as the board moves through the water, the water tends to be turbulent along that section of the board. The performance of the board is not harmed if the protector forms a bump on the corner section because the turbulent water flow is not affected by the protector.

The bottom edge 24 of the tail protector is above the bottom surface 20 of the board and may extend partially down the undersigned corner section 22 of the board. Because the tail protector does not extent to any significant extent onto the bottom of the surfboard, the protector does not disrupt the flow of water along the bottom as the board moves through the water. Because the tail protector does not drag through the water, the edge of the tail protector does not interfere with the performance of the board as it moves through the water. In actual testing of a prototype similar to that illustrated in FIGS. 1 through 4, two different experienced surfers were not able to tell any difference whatsoever in the performance of the board with or without the tail protector 10.

Figure 5:
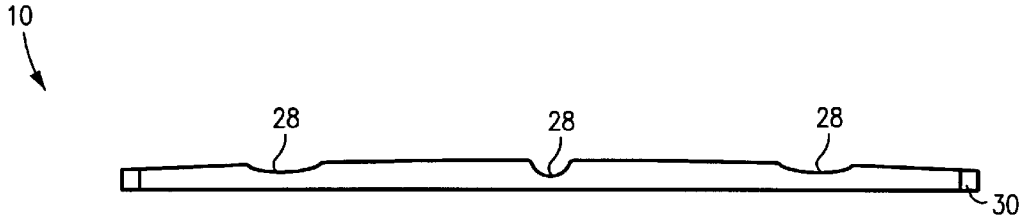
FIG. 5 is a rear view of the tail protector not mounted on the surfboard.
Figure 6:
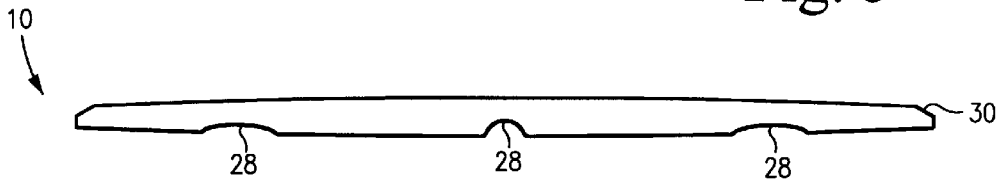
FIG. 6 is a top plan view of the tail protector not mounted on the surfboard.
Figure 7:
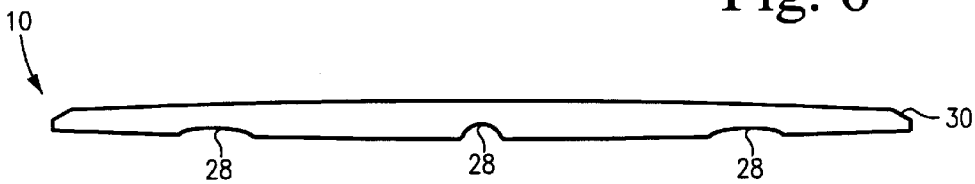
FIG. 7 is a bottom plan view of the tail protector not mounted on the surfboard.

FIGS. 5, 6 and 7 show a configuration of an exemplary embodiment of an unmounted tail protector 10 in back, bottom, and top views, respectively. The tail protector is a flexible strip of plastic material that wraps around the rear edge of a surfboard. The rear edge of the surfboard generally has a pair of sharp corners 26 around which the tail protector must fit.

To assist the tail protector in wrapping around the corners of the rear of the surfboard, the tail protector has a plurality of curved slots 28 (three slots are shown in the exemplary embodiment illustrated in the drawings) that allow the protector strip to bend around the rear corners 26 and conform to various rear tail shapes of surfboards. The edges of the protectors are preferably beveled or curved and thin, allowing the protectors to blend with the surfaces of the board. The ends 30 of the tail protector may be beveled to provide a smooth transition section where leading ends of the protector are attached to the sides of the surfboard. The tail protectors may be made in various sizes and shapes to fit surfboards, skateboards, snowboards, wakeboards, and other sport boards.

The tail protectors are preferably manufactured from injected molded thermoplastic elastomer, such as a urethane. A typical durometer is between about 20–80 shore A, e.g. approximately a 40 A shore diameter being highly desirable. Urethane with an approximately 40 A shore diameter is tough, soft and pliable, and creates an excellent shock absorbing bumper.

Figure 4:
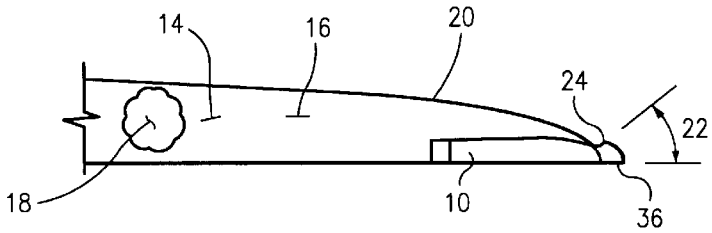
FIG. 4 is a side edge view of the surfboard and tail protector shown in FIG. 1.
Figure 8:
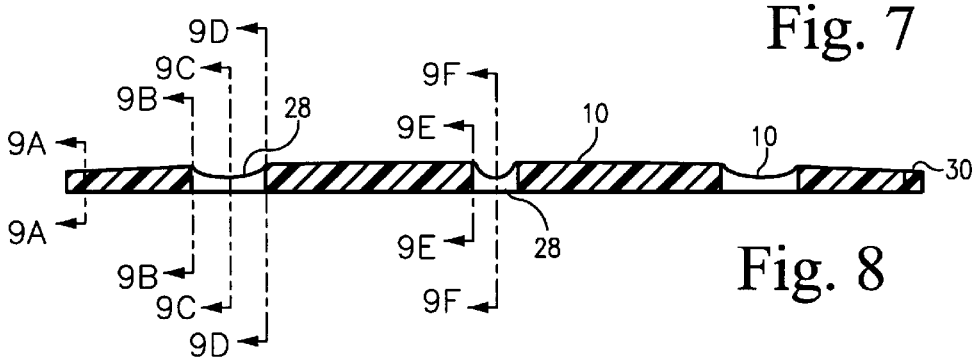
FIG. 8 is a rear view of the tail protector not mounted on the surfboard, wherein the figure shows section lines for cross-sectional figures.
Figure 16:
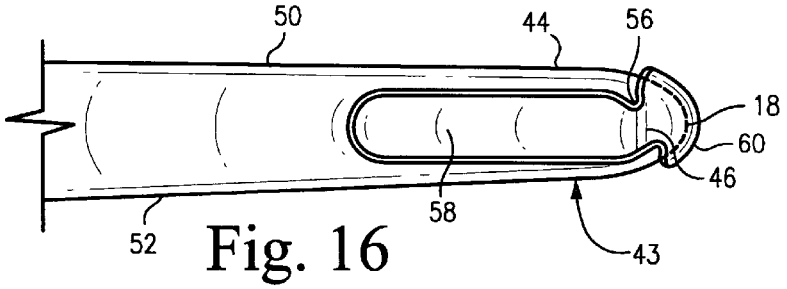
FIG. 16 is a side edge view of a third embodiment of the tail protector mounted on the surfboard.

FIG. 8 is a rear view of the tail protector 11 and FIGS. 9A, 9B, 9C, 9D, 9E and 9F show cross-sectional views of the protector at section lines shown in FIG. 8. The tail protectors wrap around the rear edge of the surfboard (or other water sport board) tail, conforming to the curvature of the rear rail of the board. The bottom edge 32 of the tail protector is configured to blend with a typical flat bottom edge of the board. The bottom edge of the protector is tapered to a point so as to blend smoothly to the underside of the corner 22 of the board. However, since the protectors do not wrap around the bottom surface of the board, it will not create drag or otherwise interfere with the flow of water as it moves from the tip of the board and trails off the end of the board, and therefore will not adversely affect performance. The inner is surface 34 of the tail protector conforms to the tail surface of the board. The top edge 36 of the protector may be blunt and extend beyond the rear tail of the surfboard (as is shown in FIG. 4). The protectors 13 also do not cover the bottom of the board, as seen in FIG. 16.

Figure 9A:
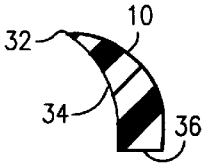
FIGS. 9A, 9B, 9C, 9D, 9E and 9F are cross-sectional views of the tail protector taken along lines 9A—9A, 9B—9B, 9C—9C, 9D—9D, 9E—9E and 9F—9F, respectively, of FIG. 8.
Figure 9B:
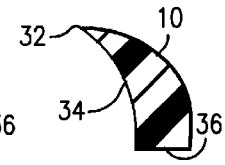
Figure 9C:
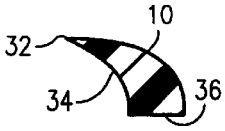
Figure 9D:
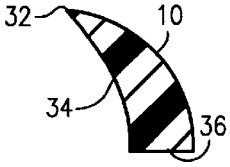
Figure 9E:
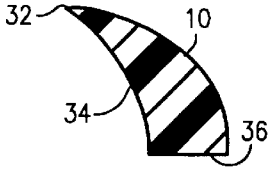
Figure 9F:
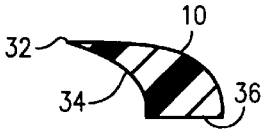

The cross section of the tail protector varies along the length of the protector. The cross-sectional shape of the protector has a generally inverted comma shape where the point of the common corresponds to the bottom edge 32 of the protector. At the beveled ends 30 of the protector, the protector is relatively wide and thin and, thus, has a cross section is long and narrow as shown in FIG. 9A. The cross section of the protector tends to be thickest near the center region 38 of the protector, as is shown in FIG. 9E. The thickness of the tail protector is gradually reduced between the center region and outwards to the ends 30. Compare FIGS. 9E, 9D, 9B and 9A. Moreover, the cross-sectional area of the tail protector is reduced in size at the slots 28 in the tail protector, as shown in FIGS. 9C and 9F.

Figure 10:
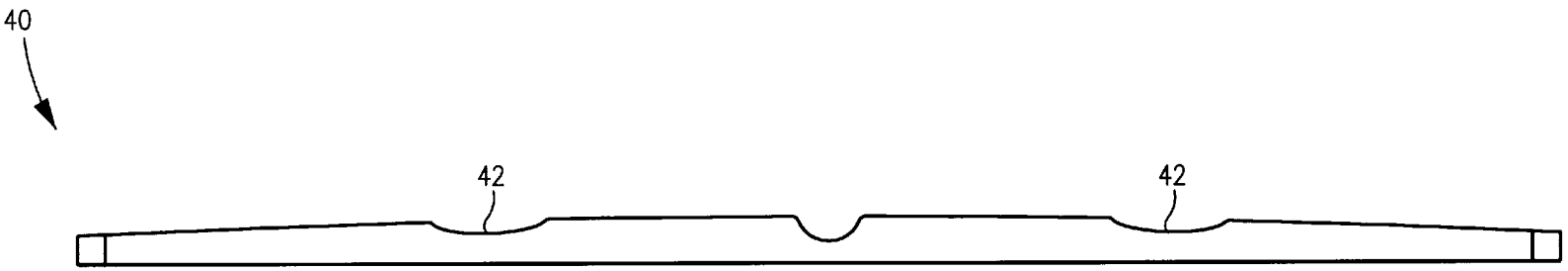
FIG. 10 is a rear view of a second embodiment of a tail protector not mounted on a surfboard.
Figure 11:
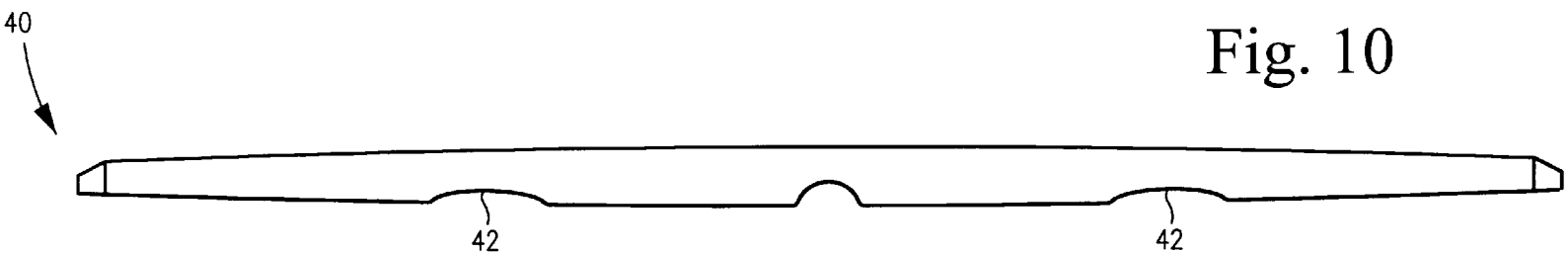
FIG. 11 is a top plan view of the second embodiment of the tail protector.
Figure 12:
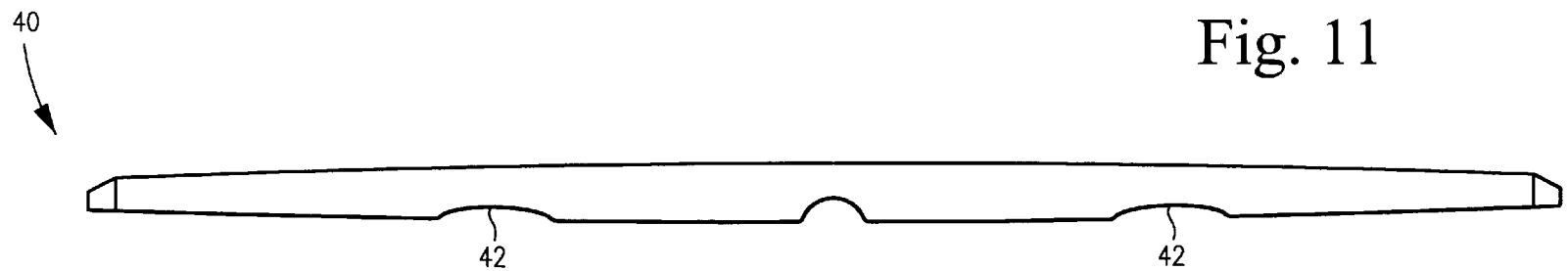
FIG. 12 is a bottom plan view of the second embodiment of the tail protector not mounted on the surfboard.
Figure 13:
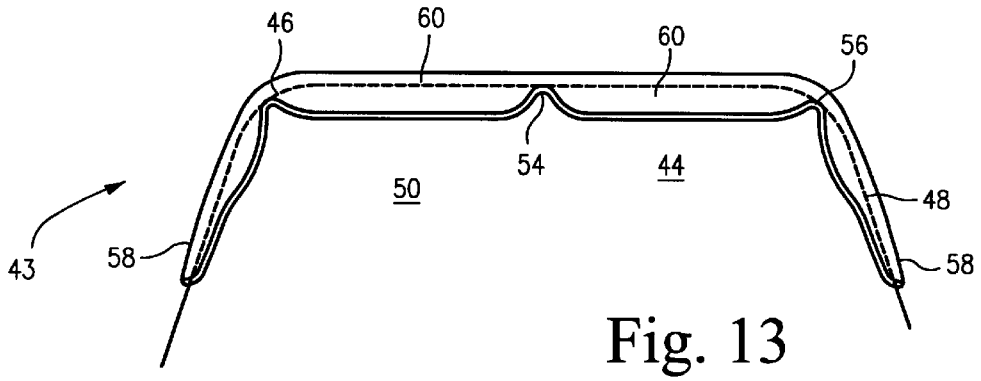
FIG. 13 is a bottom view of a third embodiment of the tail protector mounted on a surfboard.
Figure 14:
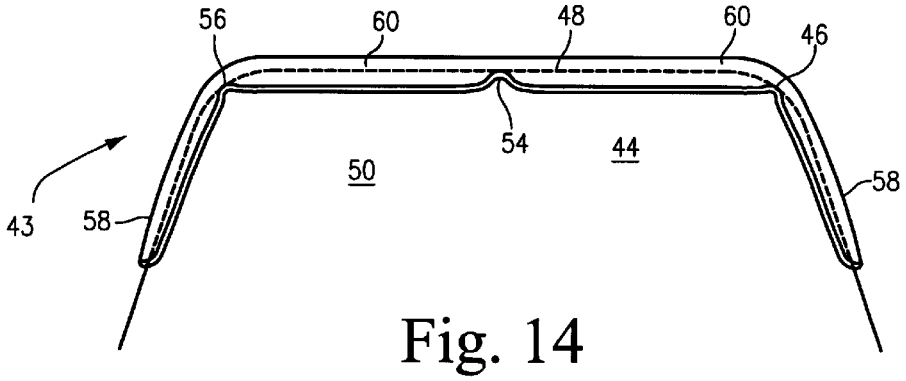
FIG. 14 a top view of a third embodiment of the tail protector mounted on the surfboad.
Figure 15:
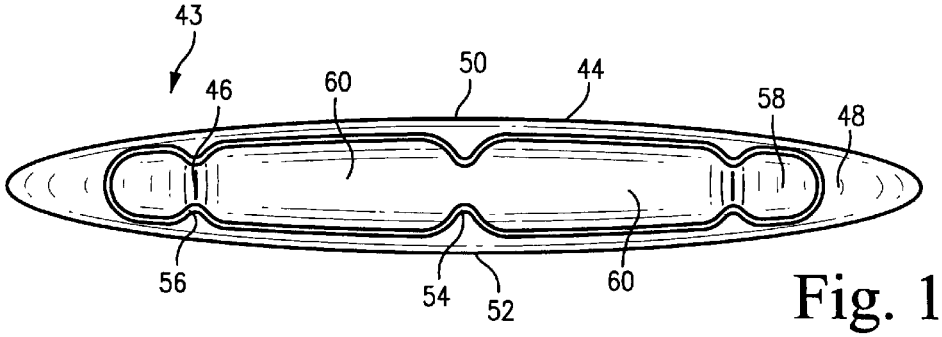
FIG. 15 is a rear edge view of a third embodiment of the tail protector mounted on the surfboard.

FIGS. 10 through 12 are back, bottom, and top views, respectively, of a tail protector 40 specifically designed for a classic long board, which has rounded edge rails. The slots 42 in the protector are elongated to allow it to bend around the corners of the long board, as compared to the corner slots 28 in a protector for a short board. In addition, the tail protector is scaled in size to conform to the tail edge of a long board. Otherwise, the tail protector for a long board is similar to the exemplary tail protector for a short board disclosed in FIGS. 1 to 9F.

Figure 3:
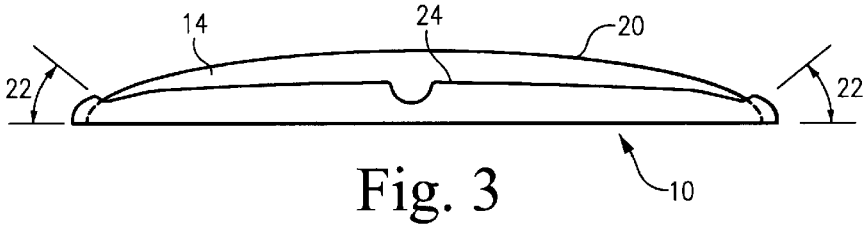
FIG. 3 is a rear edge view of the surfboard and tail protector shown in FIG. 1.

FIGS. 13 to 16 show a tail protector 43 on an exemplary round rail surfboard tail 44. The round rail 44 has larger radius corners 46 that does the sharp cornered board shown in FIG. 1. In addition, the edges (rails) 48 of the round rail board are more rounded than the edges of the board shown in FIG. 1. Moreover, a round rail board in cross section is relatively elliptical (see FIG. 15), whereas a traditional board (such as shown in FIGS. 3 and 4) have cross sections that are generally flat on top and curved on the bottom. The rails on a round rail surfboard curve towards the upper portion 50 of the board, as well as being curved towards the bottom 52 of the board.

The tail protector 43 for the round rail board is shaped to conform to the curved rails. The protector has a center slotted section 54 that is necked to allow the protector to bend around and conform to the rail of the board. Similarly, the protector has corner slots 56 that allow the protector to bend around the corners of the tail section of the board. End sections 58 of the protector cover the tail of the board on either side of the center slot 54. These end sections are substantially "C" shaped in cross section (as shown in FIG. 16) and cover a substantial portion of the rail at the tail of the board. The end sections may extend further upward around the rail and towards the upper section of the board and do they extend downward around the rail and towards the bottom of the board. Thus, the cross sectional shape of the protector is such that it is offset towards the top of the board and away from the bottom of the board. These end sections protect the tail of the board from damage by forming a rear bumper on the board. However, the end sections do not extend to the bottom 52 of the board and, thus, do not interfere with the performance of the board as it moves through the water.

In addition, the protector 43 includes side sections 60 that extend along the rails from the corner slots 56 of the protector and towards the front of the board. These side sections may be narrower in cross section than are the end sections 58, but otherwise have a similar "C" cross section that is offset to the top of the board. The side sections provide a bumper for the rear sides of the board that are adjacent the tail of the board. The end sections may be integral with the side sections of the protector, where the sections are connected by the corner slots 56. Alternatively, the opposite side s and pair of end sections may be separated. If the side sections are separate from the end sections, and the end sections are separated from each other, then there is no need for the slotted sections. The separated sections can be adhesively attached to the rails of the board in a similar manner as is the integral protector attached to the board.

Figure 17:
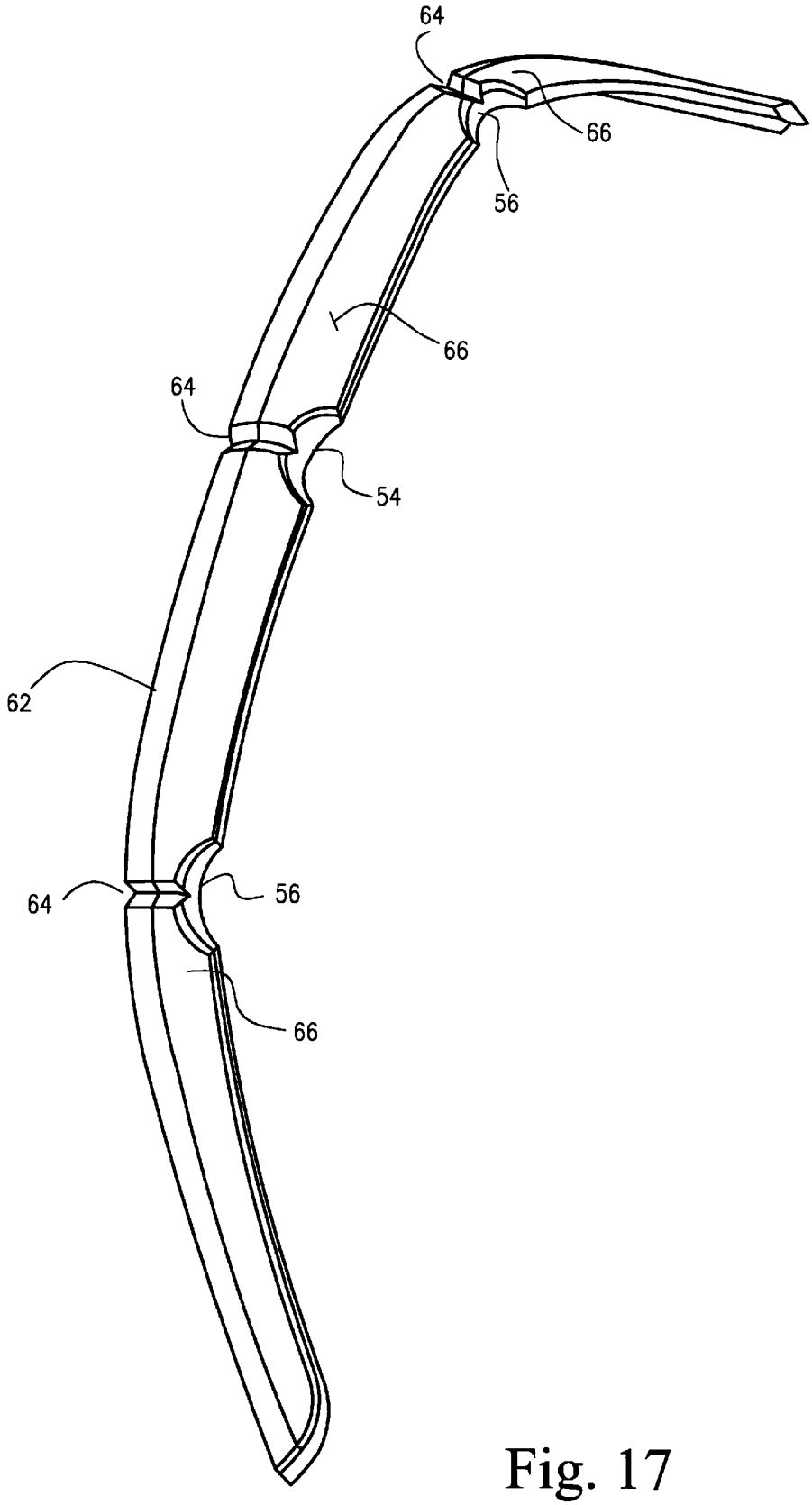
FIG. 17 is a perspective view of a modified third embodiment of the tail protector.

FIG. 17 is a perspective view of a tail protector 62 similar to tail protector 43, but modified to include "V" grooves 64 in the outside surfaces 66 of the protector. These grooves 66 facilitate the bending of the protector as it is mounted on the tail of a surfboard. These V-grooves are aligned with the center 54 and corner slots 56 on the tail protector.

The configurations in FIGS. 1 through 16 are exemplary only, and the dimensions, and details, of the configurations will vary from board to board, and also from type of board to type of board (that is for other water sport boards besides surfboards the configuration may be different).

The invention has been described in connection with the best mode now know to the inventors. The invention is not to be limited to the disclosed embodiment. Rather, the invention covers all of various modifications and equivalent arrangements included within the spirit and scope of the appended claims.

What is claimed is:

1. A tail protector for a surfboard having a tail edge and a bottom surface, said tail protector comprising:

a strip of material attached to an outer surface of said tail edge, wherein said material substantially covering the tail edge;

said strip having a lower edge extending below the tail edge and above the bottom surface, wherein the strip of material is offset towards an upper section of the surfboard when attached to the tail edge.

2. A tail protector as in claim 1 wherein the strip of material is a thick deformable material that forms a bumper on the tail edge of the surfboard.

3. A tail protector as in claim 1 wherein the strip of material is formed of a soft deformable material.

4. A tail protector as in claim 1 wherein the strip of material has a cross section tapered towards the bottom surface of the board.

5. A tail protector as in claim 4 wherein the strip of material has a cross section including a flat section and said flat section is aligned with the upper surface when the protector is attached to the board.

6. A tail protector as in claim 1 wherein the strip of material has a center slot to be aligned with a center of said tail edge.

7. A tail protector as in claim 1 wherein the strip of material has a pair of corner slots to be aligned with corners at opposite sides of said tail edge.

8. A tail protector for a surfboard having a tail edge and a bottom surface, said tail protector comprising:

a strip of material attached to an outer surface of said tail edge, wherein said material substantially covering the tail edge;

said strip having a lower edge extending below the tail edge and above the bottom surface, wherein the strip of material has a cross section substantially "C" in cross section.

9. A tail protector for a surfboard having a tail edge and a bottom surface, said tail protector comprising:

a strip of material attached to an outer surface of said tail edge, wherein said material substantially covering the tail edge;

said strip having a lower edge extending below the tail edge and above the bottom surface, wherein said lower edge extends below the tail edge a shorter distance than a distance than an upper edge of the tail protector extends above the tail edge.

10. A tail protector as in claim 9 wherein said protector is adhesively attached to said tail edge.

11. A tail protector as in claim 9 wherein said strip is contiguous.

12. A tail protector as in claim 9 wherein the strip of material is a thick deformable material that forms a bumper on the tail edge of the surfboard.

13. A tail protector as in claim 9 wherein the strip of material is formed of a soft deformable material.

14. A tail protector as in claim 9 wherein the strip of material has a cross section tapered towards the bottom surface of the board.

15. A tail protector as in claim 14 wherein the strip of material has a cross section including a flat section and said flat section is aligned with the upper surface when the protector is attached to the board.

16. A tail protector as in claim 9 wherein the strip of material has a center slot to be aligned with a center of said tail edge.

17. A tail protector as in claim 9 wherein the strip of material has a pair of corner slots to be aligned with corners at opposite sides of said tail edge.

18. A tail protector as in claim 9 wherein said protector is adhesively attached to said tail edge.

19. A tail protector as in claim 9 wherein said strip is contiguous.

20. A tail protector as in claim 9 wherein said strip includes at least one groove on an outside surface of the strip.

21. A tail protector as in claim 20 where said at least one groove is aligned with a slot on the strip to be aligned with a corner of the tail edge.

22. A tail protector as in claim 21 wherein the slot is a necked down region of the strip.

23. A tail protector for a surfboard having a tail edge and a bottom surface, said tail protector comprising:

a strip of material attached to an outer surface of said tail edge, wherein said material substantially covering the tail edge;

said strip having a lower edge extending below the tail edge and above the bottom surface, wherein said strip includes at least one end section attachable to said tail edge and a pair of corner sections attachable to side edges of the surfboard, wherein said corner sections have a narrower cross section than said at least one end section.

24. A tail protector as in claim 23 wherein said strip includes at least one groove on an outside surface of the strip.

25. A tail protector as in claim 24 where said at least one groove is aligned with a slot on the strip to be aligned with a corner of the tail edge.

26. A tail protector as in claim 25 wherein the slot is a necked down region of the strip.

* * * * *

UNITED STATES PATENT AND TRADEMARK OFFICE

CERTIFICATE OF CORRECTION

PATENT NO. : 6,450,848 B1
DATED : September 17, 2002
INVENTOR(S) : David Skedeleski It is certified that error appears in the above-identified patent and that said Letters Patent is hereby corrected as shown below:

Title page,
Item [73], Assignee: kindly delete "Surfoo" and insert -- Surfco -- therefor.

Signed and Sealed this

Twenty-fifth Day of February, 2003

JAMES E. ROGAN
*Director of the United States Patent and Trademark Office*